US011543160B2

(12) United States Patent
Mannewitz et al.

(10) Patent No.: US 11,543,160 B2
(45) Date of Patent: Jan. 3, 2023

(54) REFRIGERANT COMPRESSOR WITH GAS EQUALIZER DUCT

(71) Applicant: BITZER Kuehlmaschinenbau GmbH, Sindelfingen (DE)

(72) Inventors: Jens Mannewitz, Schkeuditz (DE); Robin Langebach, Dresden (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 222 days.

(21) Appl. No.: 16/691,931

(22) Filed: Nov. 22, 2019

(65) Prior Publication Data

US 2020/0166250 A1 May 28, 2020

(30) Foreign Application Priority Data

Nov. 22, 2018 (DE) ..... 10 2018 129 473.5

(51) Int. Cl.
*F25B 31/00* (2006.01)
*F04B 39/02* (2006.01)
*F04B 39/04* (2006.01)

(52) U.S. Cl.
CPC ..... *F25B 31/002* (2013.01); *F04B 39/02* (2013.01); *F04B 39/023* (2013.01); *F04B 39/0284* (2013.01); *F04B 39/04* (2013.01)

(58) Field of Classification Search
CPC ..... F25B 31/002; F04B 39/02; F04B 39/023; F04B 39/0284; F04B 39/04
See application file for complete search history.

(56) References Cited

U.S. PATENT DOCUMENTS 3,713,513 A * 1/1973 Harris ..... F25B 31/002 184/6.16
4,580,949 A * 4/1986 Maruyama ..... F25B 1/04 417/295
5,591,011 A * 1/1997 Mantooth ..... F04B 39/0246 417/372

(Continued)

FOREIGN PATENT DOCUMENTS

CN 1388346 A 1/2003
CN 201972893 U 9/2011

(Continued)

*Primary Examiner* — Jerry-Daryl Fletcher
*Assistant Examiner* — Daniel C Comings
(74) *Attorney, Agent, or Firm* — Reinhart Boerner Van Deuren P.C.

(57) ABSTRACT

A refrigerant compressor for a refrigeration system comprises a common housing, a compressor unit arranged in the common housing, a mechanical compressor drive unit for the compressor unit, arranged in a drive chamber, a lubricant bath forming in the drive chamber, an intake duct that extends in a manner separated from the drive chamber and through which the compressor unit draws in by suction refrigerant that is to be compressed. The intake duct and the drive chamber are connected by a gas equaliser duct, which allows a permanent equalisation of gas, and which has on one side an opening on the drive chamber side and on the other an opening on the intake side, and of which the duct length between the openings corresponds to at least twice an equivalent duct diameter, in particular a smallest equivalent duct diameter, of the gas equaliser duct.

23 Claims, 8 Drawing Sheets

(56) References Cited

U.S. PATENT DOCUMENTS

| | | | | |
|---|---|---|---|---|
| 6,131,406 | A | 10/2000 | Barowsky et al. | |
| 7,260,951 | B2 * | 8/2007 | Monk | F04C 28/06 62/196.3 |
| 2002/0189266 | A1 * | 12/2002 | Suitou | C10M 171/008 62/114 |
| 2010/0221128 | A1 | 9/2010 | Mellar et al. | |
| 2011/0274575 | A1 * | 11/2011 | Obrist | F04B 27/109 418/55.1 |
| 2015/0240798 | A1 * | 8/2015 | Sato | F04B 39/0022 417/374 |
| 2018/0340526 | A1 * | 11/2018 | Goel | F04B 39/121 |

FOREIGN PATENT DOCUMENTS

| | | | |
|---|---|---|---|
| CN | 106870333 | A | 6/2017 |
| DE | 19726943 | A1 | 1/1999 |
| DE | 10323381 | B3 | 3/2005 |
| DE | 102007042318 | A1 | 3/2009 |
| SU | 737643 | A1 | 5/1980 |

* cited by examiner

REFRIGERANT COMPRESSOR WITH GAS EQUALIZER DUCT

CROSS-REFERENCE TO RELATED PATENT APPLICATION

This patent application claims the benefit of German application No. 10 2018 129 473.5, filed Nov. 22, 2018, the teachings and disclosure of which are hereby incorporated in their entirety by reference thereto.

BACKGROUND OF THE INVENTION

The invention relates to a refrigerant compressor, in particular for a refrigeration system, including a common housing, a compressor unit arranged in the common housing, a mechanical compressor drive unit for the compressor unit, arranged in a drive chamber of the common housing, a lubricant bath forming in the drive chamber, an intake duct that extends in the common housing in a manner separated from the drive chamber and through which the compressor unit draws in by suction refrigerant that is to be compressed.

Refrigerant compressors of this kind are known from the prior art.

In common, they have the problem that on the outtake side of the compressor an appreciable spurt of lubricant occurs—that is to say there is an appreciable proportion of lubricant in the compressed refrigerant—which is undesirable.

The object of the invention is therefore to provide a refrigerant compressor in which the spurting of lubricant is reduced to the greatest possible extent.

SUMMARY OF THE INVENTION

This object is achieved according to the invention in the case of a refrigerant compressor of the type described in the introduction, in that the intake duct and the drive chamber are connected by way of a gas equaliser duct, which allows a permanent equalisation of gas between them, and which has on one side an opening on the drive chamber side and on the other an opening on the intake duct side, and of which the duct length between the openings corresponds to at least twice an equivalent duct diameter, in particular a smallest equivalent duct diameter, of the gas equaliser duct.

The advantage of this solution can be seen in the fact that on the one hand, as a result of the permanent equalisation of gas by way of the gas equaliser duct, the refrigerant compressor operates to the optimum because there is always equalisation of gas between the drive chamber and the intake duct for the purpose of equalising variations in pressure triggered by blow-by flows or other effects, and on the other hand, because of the duct length of the gas equaliser duct, lubricant, in particular lubricant droplets, is prevented from being transported from the opening on the drive chamber side, through the opening on the intake duct side and into the intake duct and resulting in a high level of spurting of lubricant on the outtake side of the refrigerant compressor.

Here, it is particularly advantageous if the duct length of the gas equaliser duct corresponds to at least three times, or better at least four times, preferably at least five times and by preference at least six times the equivalent duct diameter.

The term "an equivalent duct diameter of the gas equaliser duct" should be understood here to mean the diameter of a circular duct cross section of which the duct cross sectional surface area corresponds to the cross sectional surface area of the gas equaliser duct, in the event that the cross sectional shape thereof differs from a circular cross sectional shape.

More detailed statements have not been made, in the context of the explanation above of the individual exemplary embodiments, as regards the absolute dimensions of the gas equaliser duct.

Here, as an alternative or in addition to the solutions described above, a particularly favourable solution provides for the gas equaliser duct to have a duct length of at least 40 mm, or better at least 60 mm, even better at least 80 mm, preferably at least 100 mm and by preference at least 110 mm.

More detailed statements have not yet been made as regards the cross sectional surface area of the gas equaliser duct either.

Here, as an alternative or in addition to the solutions described above, it is particularly advantageous if the gas equaliser duct has a duct cross sectional surface area of at least 80 $mm^2$, or better at least 120 $mm^2$, even better at least 180 $mm^2$, by preference at least 250 $mm^2$ and by particular preference at least 300 $mm^2$, since a minimum cross sectional surface area of this kind improves gas equalisation, in particular because of the smaller flow losses.

In order to reduce to the greatest possible extent the conveying of lubricant, in particular lubricant droplets, into the intake duct, it is preferably provided for the opening in the gas equaliser duct on the drive chamber side to be higher up, as seen in the direction of gravity, than the lubricant bath of the drive chamber.

Further, it is particularly favourable if the opening in the gas equaliser duct on the drive chamber side is arranged at least at the height of a drive shaft of the compressor drive unit, as seen in the direction of gravity.

It is particularly advantageous if the opening in the gas equaliser duct on the drive chamber side is arranged laterally next to the compressor drive unit in the drive chamber.

Further, it is preferably provided for the opening in the gas equaliser duct on the intake duct side to be higher up, as seen in the direction of gravity, than the accumulation of lubricant in the intake duct.

Further, if the intake duct and the drive chamber are separated from one another by a separating element, in particular a separating wall of the common housing, it is preferably provided for the gas equaliser duct to pass through a separating element between the drive chamber and the intake duct.

An optimal spatial arrangement of the gas equaliser duct is produced if the gas equaliser duct extends within or along the drive chamber over at least half of its duct length.

Functioning of the gas equaliser duct is particularly optimal if, as gas is equalised in the gas equaliser duct, a column of gas lying between the openings moves to and fro in the gas equaliser duct without flowing through the gas equaliser duct—that is to say that the column of gas does not pass through the entire gas equaliser duct in its entirety but at least a substantial proportion—that is to say for example at least a third of its length—remains within the gas equaliser duct.

A further optimal solution provides for a column of gas lying between the openings to move to and fro in the gas equaliser duct with the suction gas pulses that occur in the intake duct such that the column of gas does not bring about any transport of lubricant droplets from the drive chamber into the intake duct.

Moreover, with an optimally effective gas equaliser duct, it is provided for a column of gas lying in the gas duct between the openings to move to and fro in the gas equaliser duct with the suction gas pulses in the intake duct only such that lubricant droplets at the opening on the drive chamber side at most enter the gas equaliser duct but do not exit from the opening thereof on the intake duct side.

More detailed statements have not been made, in the context of the explanation above of the invention, as regards the arrangement of the gas equaliser duct.

The gas equaliser duct may take any desired course, for example being straight or curved or bent, provided the duct length and cross sectional surface area fulfil the conditions mentioned in the introduction.

For example, the gas equaliser duct could be arranged on an outer side of the common housing.

However, it is particularly favourable if the gas equaliser duct is arranged within the common housing.

In this case, the gas equaliser duct may be formed by a separate part that is arranged in the common housing and is held for example against a housing wall, or may take the form of a duct integrated in the common housing.

Further, it is advantageously provided for the gas equaliser duct merely to connect the intake duct that extends within the common housing to the drive chamber but not to extend for example as far as cylinder heads mounted on the common housing or into suction chambers of these cylinder heads. A structurally particularly simple and hence advantageous solution provides for the intake duct to pass through a motor compartment in the common housing and for the accumulation of lubricant to form on the base of the motor compartment.

In this case, it is structurally particularly advantageous if the gas equaliser duct connects the drive chamber to the motor compartment.

In particular if lubricant is deposited in the intake duct, a lubricant return line is provided which supplies lubricant from an accumulation of lubricant forming in the intake duct to the drive chamber, and which in particular prevents lubricant from being transported from the drive chamber into the intake duct.

Moreover, as regards a lubricant return line, a particularly favourable solution provides for this to include a nonreturn valve that is either effective directly between the intake duct and the drive chamber or is associated with a duct extending between the intake duct and the drive chamber, such that the nonreturn valve prevents lubricant from being transported from the drive chamber into the intake duct.

The solution described above is particularly advantageous in the case of a lubricant return line, since, as a result of the gas equaliser duct according to the invention, the lubricant return line operates to the optimum and in particular there are no fluctuations in pressure because of the lubricant return line.

A particularly advantageous solution provides for the refrigerant compressor to be a semi-hermetic compressor, in which flow of the intake duct passes through the motor compartment for the purpose of cooling the drive motor.

More detailed statements have likewise not yet been made as regards the compressor unit.

Here, in principle the compressor unit could take any desired form.

However, a particularly advantageous solution provides for the compressor unit to take the form of a piston compressor unit.

Further, specific statements have not been made as regards the compressor drive unit either, since the construction thereof also depends on the compressor unit.

One advantageous solution provides for the compressor drive unit to include a drive shaft, in particular a crankshaft, having cams and connecting rods driven by these.

Thus, the above description of solutions according to the invention includes in particular the different combinations of features that are defined by the consecutively numbered embodiments below:

1. A refrigerant compressor, in particular for a refrigeration system, including a common housing (12), a compressor unit (16) arranged in the common housing (12), a mechanical compressor drive unit (32) for the compressor unit (16), arranged in a drive chamber (34) of the common housing (12), a lubricant bath (48) forming in the drive chamber (34), an intake duct (84) that extends in the common housing (12) in a manner separated from the drive chamber (34) and through which the compressor unit (16) draws in by suction refrigerant that is to be compressed, characterised in that the intake duct (84) and the drive chamber (34) are connected by way of a gas equaliser duct (112), which allows a permanent equalisation of gas between them, and which has on one side an opening (114) on the drive chamber side and on the other an opening (116) on the intake side, and of which the duct length (L) between the openings (114, 116) corresponds to at least twice an equivalent duct diameter (AD), in particular a smallest equivalent duct diameter (AD), of the gas equaliser duct (112).

2. A refrigerant compressor according to embodiment 1, characterised in that the duct length (L) of the gas equaliser duct (112) corresponds to at least three times, or better at least four times, preferably at least five times and by preference at least six times the equivalent duct diameter (AD).

3. A refrigerant compressor according to the precharacterising clause of embodiment 1 or one of the preceding embodiments, characterised in that the gas equaliser duct (112) has a duct length (L) of at least 40 mm, or better at least 60 mm, even better at least 80 mm, preferably at least 100 mm and by preference at least 110 mm.

4. A refrigerant compressor according to the precharacterising clause of embodiment 1 or one of the preceding embodiments, characterised in that the gas equaliser duct (112) has a duct cross sectional surface area (Q) of at least 80 $mm^2$, or better at least 120 $mm^2$, even better at least 180 $mm^2$, by preference at least 250 $mm^2$ and by particular preference at least 300 $mm^2$.

5. A refrigerant compressor according to one of the preceding embodiments, characterised in that the opening (114) in the gas equaliser duct (112) on the drive chamber side is higher up, as seen in the direction of gravity, than the lubricant bath (48) in the drive chamber (34).

6. A refrigerant compressor according to one of the preceding embodiments, characterised in that the opening (114) in the gas equaliser duct (112) on the drive chamber side is arranged at least at the height of a drive shaft (38) of the compressor drive unit (32), as seen in the direction of gravity.

7. A refrigerant compressor according to one of the preceding embodiments, characterised in that the opening (114) in the gas equaliser duct (112) on the drive chamber side is arranged laterally next to the compressor drive unit (32) in the drive chamber (34).

8. A refrigerant compressor according to one of the preceding embodiments, characterised in that the opening (116) in the gas equaliser duct (112) on the intake duct side is higher up, as seen in the direction of gravity, than the accumulation (102) of lubricant in the intake duct (84).

9. A refrigerant compressor according to one of the preceding embodiments, characterised in that the gas equaliser duct (112) passes through a separating element (72) between the drive chamber (34) and the intake duct (84).

10. A refrigerant compressor according to one of the preceding embodiments, characterised in that the gas equaliser duct (112) extends within or along the drive chamber (34) over at least half of its duct length (L).

11. A refrigerant compressor according to one of the preceding embodiments, characterised in that, as gas is equalised in the gas equaliser duct (112), a column of gas lying between the openings (114, 116) moves to and fro in the gas equaliser duct (112) without flowing through the gas equaliser duct (112).

12. A refrigerant compressor according to one of the preceding embodiments, characterised in that a column of gas lying between the openings (114, 116) moves to and fro in the gas equaliser duct (112) with the suction gas pulses that occur in the intake duct (84) such that the column of gas does not bring about any transport of lubricant droplets from the drive chamber (34) into the intake duct (84).

13. A refrigerant compressor according to one of the preceding embodiments, characterised in that a column of gas lying in the gas equaliser duct (112) between the openings (114, 116) moves to and fro in the gas equaliser duct (112) with the suction gas pulses in the intake duct (84) only such that lubricant droplets at the opening (114) on the drive chamber side at most enter the gas equaliser duct (112) but do not exit from the opening (116) thereof on the intake side.

14. A refrigerant compressor according to one of the preceding embodiments, characterised in that the intake duct (84) passes through a motor compartment (54) in the common housing (12), and in that the accumulation (102) of lubricant forms on the base of the motor compartment (54).

15. A refrigerant compressor according to one of the preceding embodiments, characterised in that the gas equaliser duct (112) connects the drive chamber (34) to the motor compartment (54).

16. A refrigerant compressor according to one of the preceding embodiments, characterised in that a lubricant return line (106) is provided which supplies lubricant from an accumulation (102) of lubricant forming in the intake duct (84) to the drive chamber (34), and which in particular prevents lubricant from being transported from the drive chamber (34) into the intake duct (84).

17. A refrigerant compressor according to one of the preceding embodiments, characterised in that a lubricant return line (106) includes a nonreturn valve.

18. A refrigerant compressor according to one of the preceding embodiments, characterised in that the refrigerant compressor is a semi-hermetic compressor, in which flow of the intake duct (84) passes through the motor compartment (54) for the purpose of cooling a drive motor (56).

19. A refrigerant compressor according to one of the preceding embodiments, characterised in that the compressor unit (16) takes the form of a piston compressor unit.

20. A refrigerant compressor according to one of the preceding embodiments, characterised in that the compressor drive unit (32) includes a drive shaft (38) having cams (42) and connecting rods (44) driven by these.

Further features and advantages of the invention form the subject-matter of the description below, and the representation in the drawing of an exemplary embodiment.

DETAILED DESCRIPTION OF THE INVENTION

Figure 1:
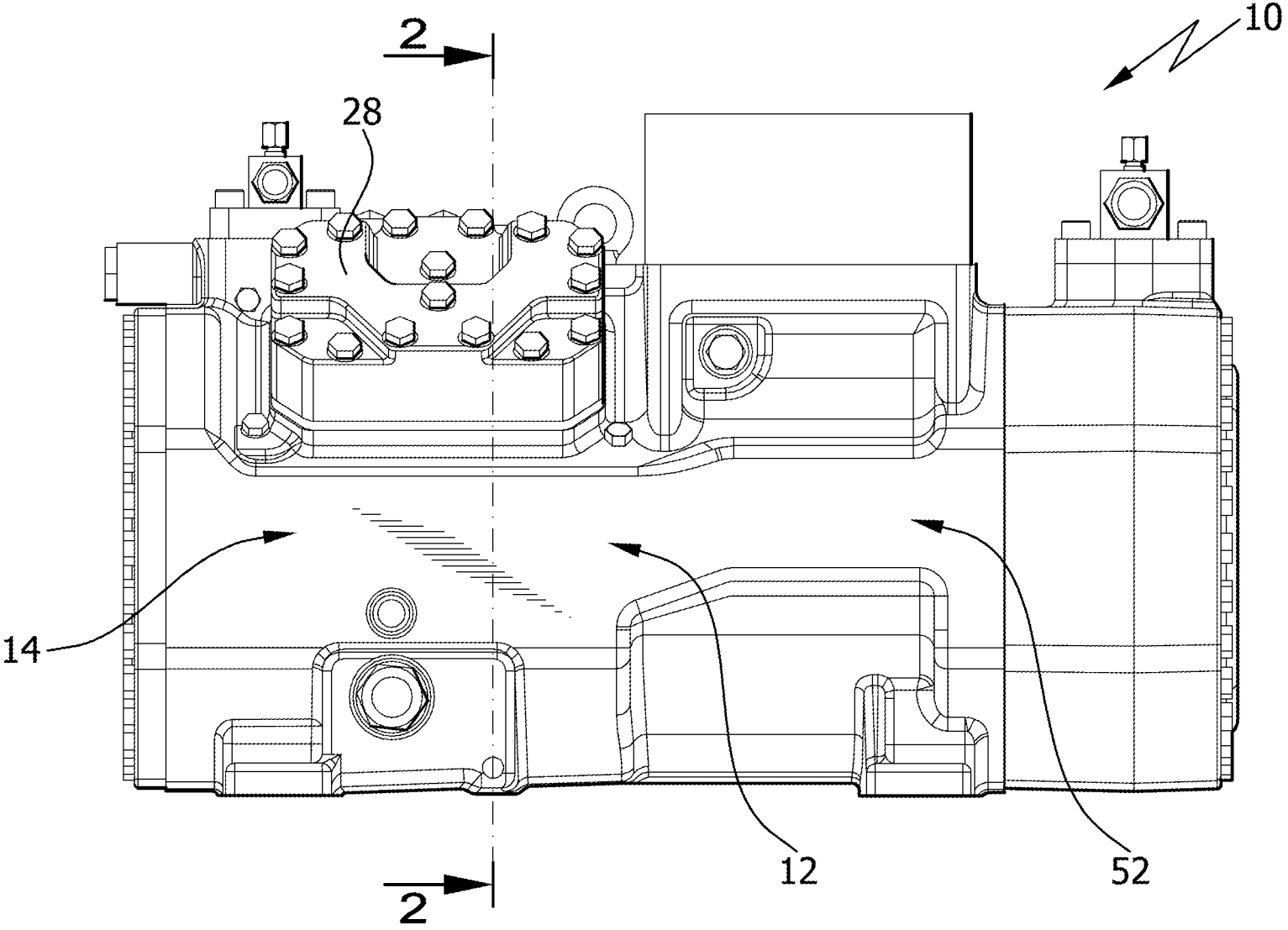
FIG. 1 shows a side view of an exemplary embodiment of a refrigerant compressor according to the invention.

An exemplary embodiment illustrated in FIG. 1, of a refrigerant compressor 10 according to the invention for a refrigeration system (not illustrated in the drawing), includes a common housing 12, which has a compressor section 14 in which there is arranged a compressor unit 16 (illustrated for example in FIG. 2 to FIG. 4) that, in the exemplary embodiment illustrated, has at least one and preferably a plurality of cylinder bores 22 with pistons 24 movable therein, wherein the cylinder bores 22 are each closed for example by a valve plate 26 that is laid on top and on which there are arranged, on an opposite side to the cylinder bores 22, cylinder heads 28 that are mounted on the common housing 12.

The individual pistons 24 of the compressor unit 16 are driven by a mechanical compressor drive unit 32 that is arranged in a drive chamber 34 of the compressor section 14 and includes for example a drive shaft 38, which is rotatable about an axis 36 and provided with cams 42 that, for their part, are coupled to the pistons 24 by means of connecting rods 44 in order to move them in the cylinder bores 22.

Further, there is formed in a floor region 46 of the drive chamber 34, which is lowest down as seen in the direction of gravity, a lubricant bath 48 in which lubricant for lubricating the compressor unit 16 and the compressor drive unit 32 accumulates, wherein this lubricant is supplied both to the compressor unit 16 and the compressor drive unit 32 for the purpose of lubrication by way of conveying elements (not illustrated) such as pump elements.

The common housing 12 further includes a motor section 52 that is arranged behind the compressor section 14, as seen in the direction of the axis 36, and surrounds a motor compartment 54 in which a motor 56, in particular an electrical drive motor, is arranged, of which the stator 62 is arranged fixed in the motor section 52, while the rotor 64 thereof is seated on a rotor shaft 66 that extends preferably coaxially in relation to the drive shaft 38 and in particular is connected in one piece therewith, and is thus likewise rotatable about the axis 36 in order to drive the drive shaft 38 of the compressor drive unit 32.

Here, in the common housing 12 in particular the drive chamber 34 and the motor compartment 54 are separated from one another by separating elements, for example a separating wall 72 that preferably carries a bearing unit for the drive shaft 38 and the rotor shaft 66.

Preferably here, the bearing unit 74 forms a bearing sleeve 76 integrally formed on the separating wall 72.

In the exemplary embodiment illustrated, there is provided in the region of the motor section 52 an intake connector 82 for the refrigerant to be compressed by the refrigerant compressor 10, through which the refrigerant enters an intake duct of the common housing 12, which is designated 84 as a whole and extends through the motor compartment 54 as far as the separating wall 72 and, after the separating wall 72, merges into a distributor 86 extending in the compressor section 14, and from the distributor 86 the refrigerant to be compressed then enters intake chambers of the cylinder heads 28, is compressed by the compressor unit 16 and is supplied, in the form of compressed refrigerant, to outtake chambers of the cylinder heads 28, from which it enters an outtake duct 94 in the common housing 14 and from there is guided to an outtake connector 96.

In refrigerant compressors of this kind, lubricant is conventionally deposited in the intake duct 84, in particular in the region of the motor compartment 54, wherein this lubricant results on the one hand from lubricant deposited from the refrigerant drawn in by suction and on the other from lubricant exiting in the region of the bearing unit 74, and forms an accumulation 102 of lubricant in the region of a lowest point 104 in the intake duct 84, in particular in the motor compartment 54. This lubricant has to be removed from the intake duct 84, for the purpose of reducing spurts of lubricant at the outtake connector 96 of the refrigerant compressor 10.

For this purpose, a lubricant return line is provided in the separating wall 72 between the intake duct 84, in particular the motor compartment 54, and the drive chamber 34, and this lubricant return line supplies lubricant from the accumulation 102 of lubricant into the drive chamber 34.

Here, it is advantageous if a backflow of lubricant into the intake duct 84 is prevented. To achieve this, there is provided a nonreturn valve 106 that only enables lubricant to be transferred from the accumulation 102 of lubricant in the intake duct 84 into the lubricant bath 48.

In order to achieve this, the pressure differences occurring between the intake duct 84 and the drive chamber 34 when the refrigerant compressor is running are used in order to act on the accumulation 102 of lubricant and cause it to pass through the nonreturn valve 106 and into the lubricant bath 48.

However, these pressure differences then bring about in particular a pumping effect that acts on the accumulation 102 of lubricant if, in addition to the nonreturn valve 106, there is a gas equalisation between the drive chamber 34 and the intake duct 84.

Figure 2:
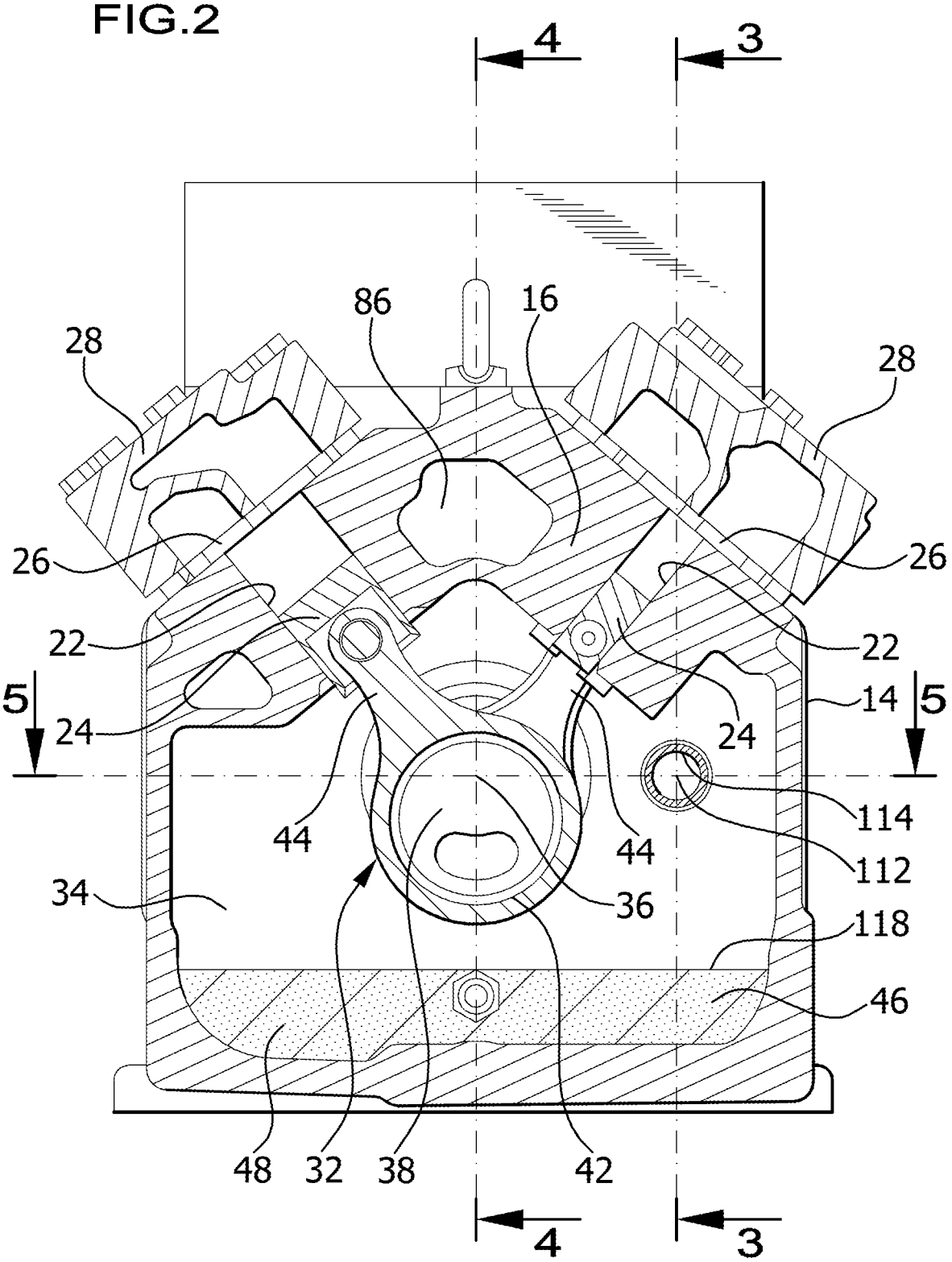
FIG. 2 shows a section along the line 2-2 in FIG. 1.
Figure 3:
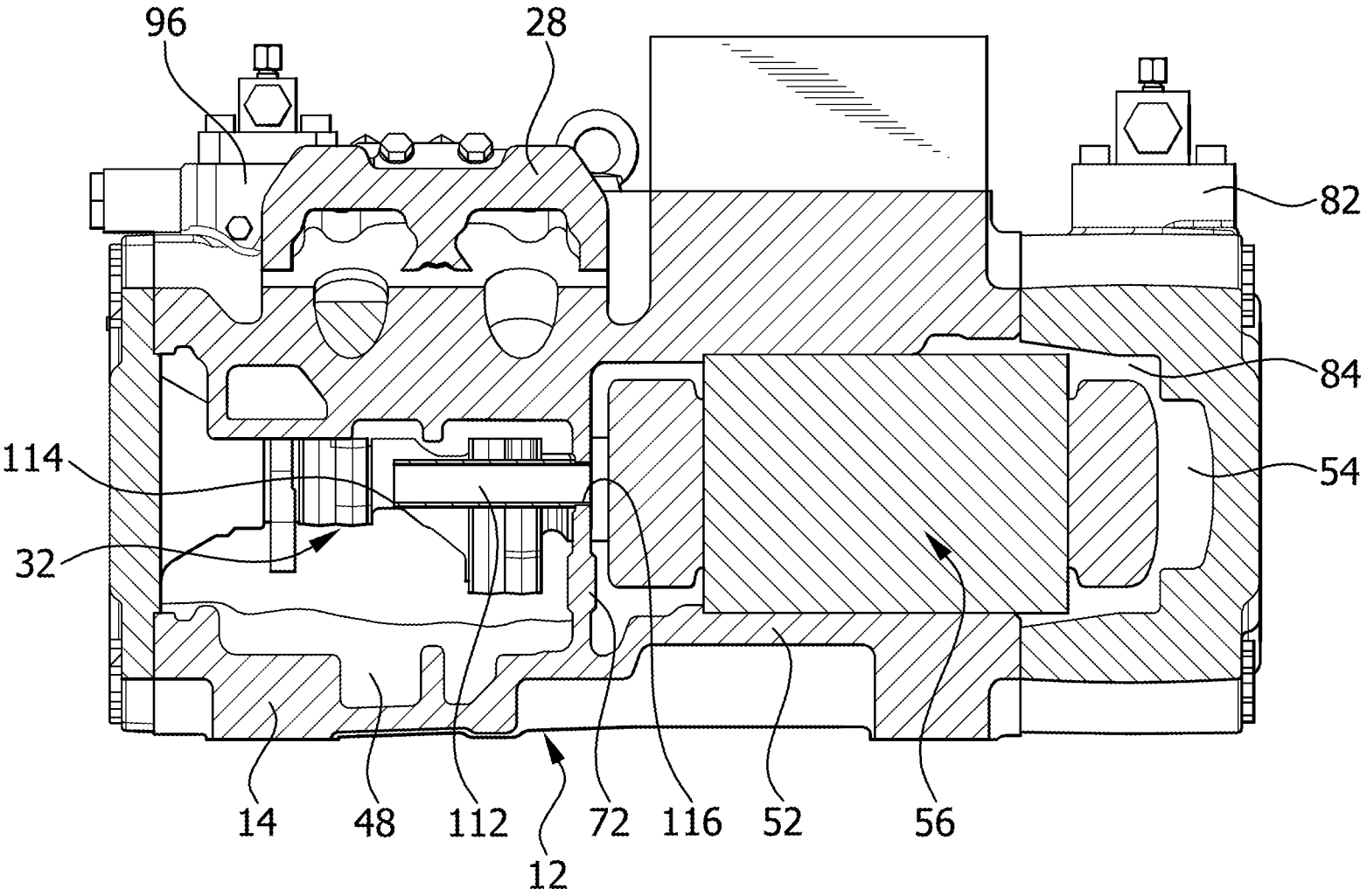
FIG. 3 shows a section along the line 3-3 in FIG. 2.
Figure 4:
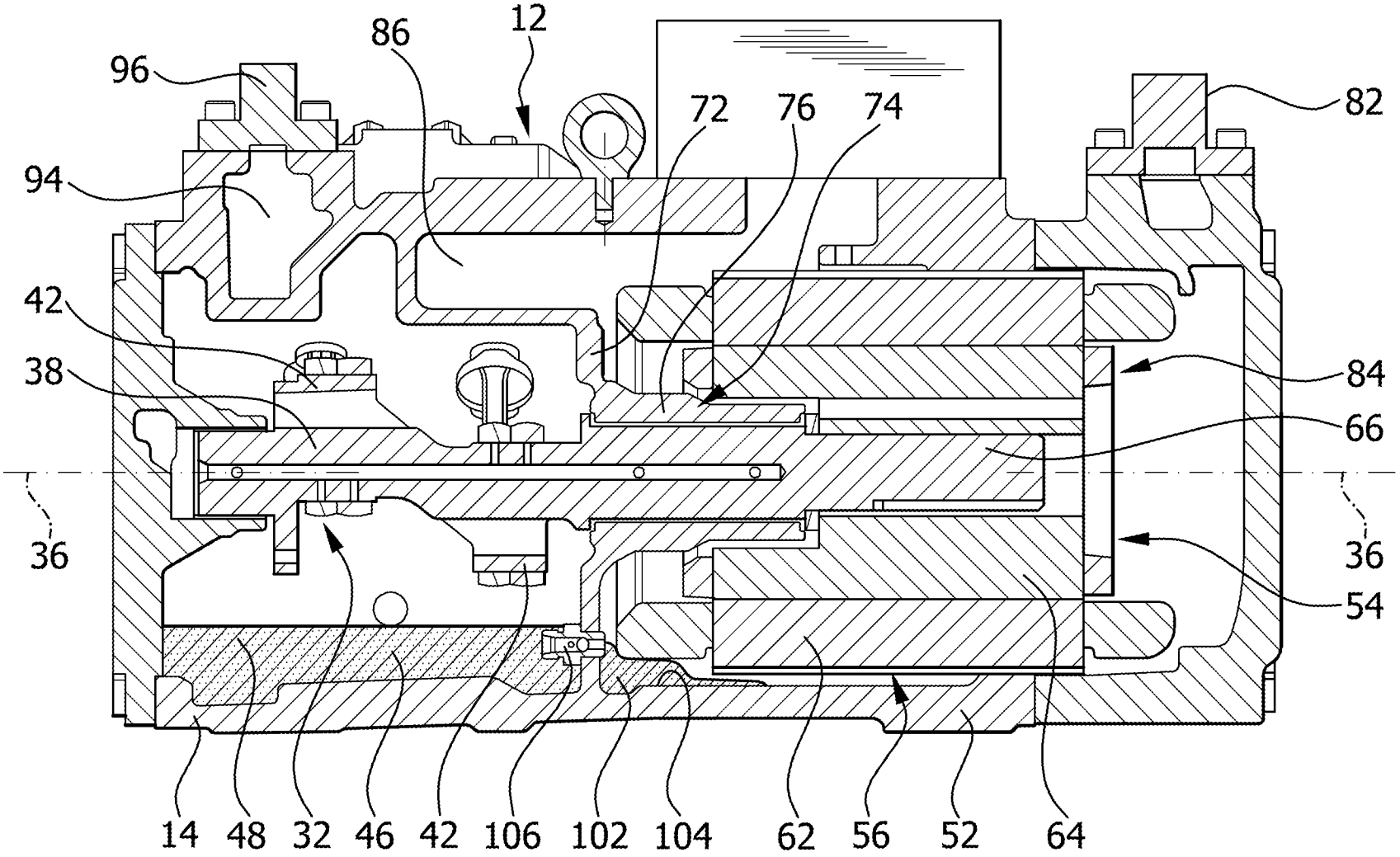
FIG. 4 shows a section along the line 4-4 in FIG. 2.
Figure 5:
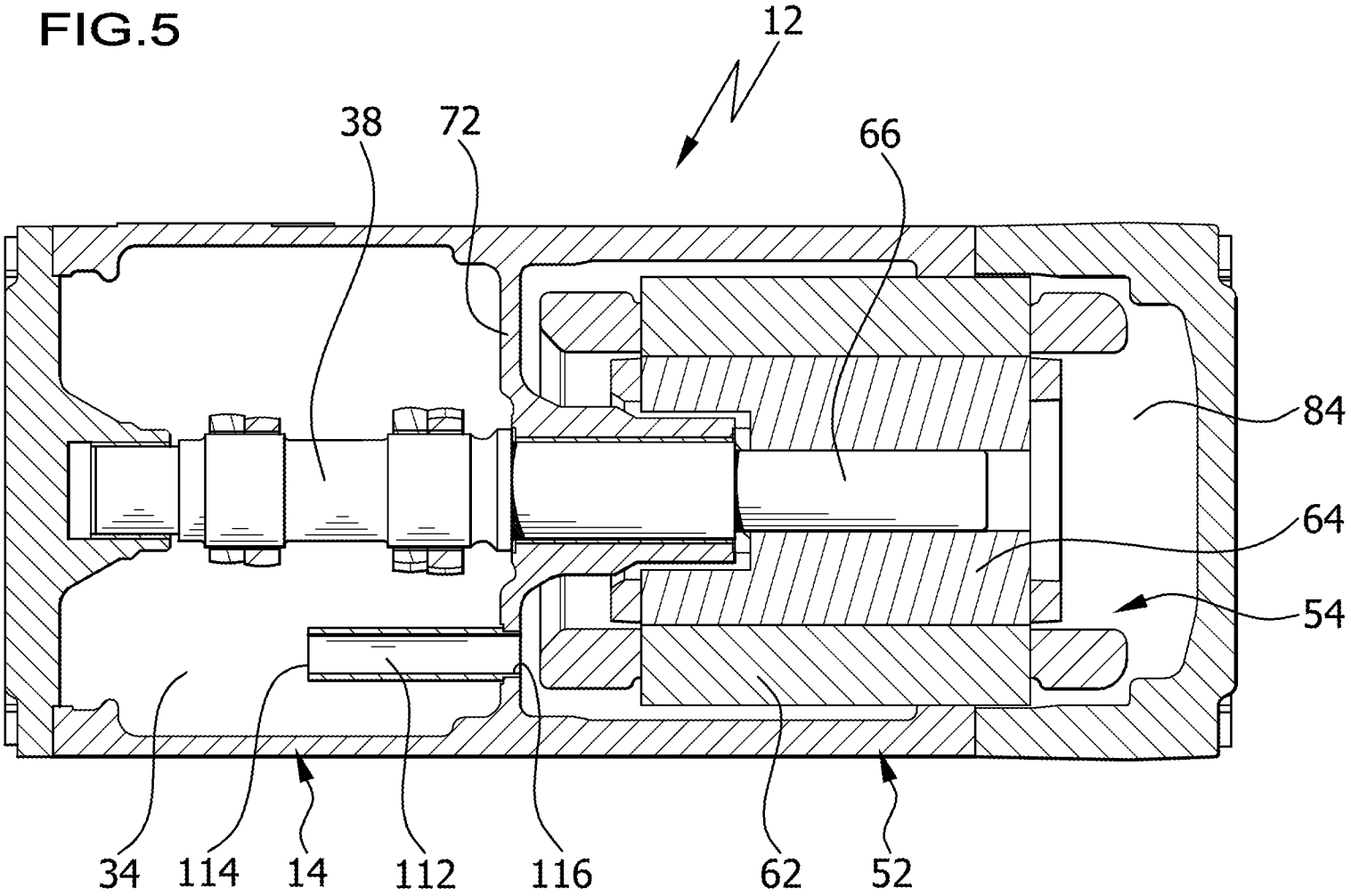
FIG. 5 shows a section along the line 5-5 in FIG. 2.
Figure 6:
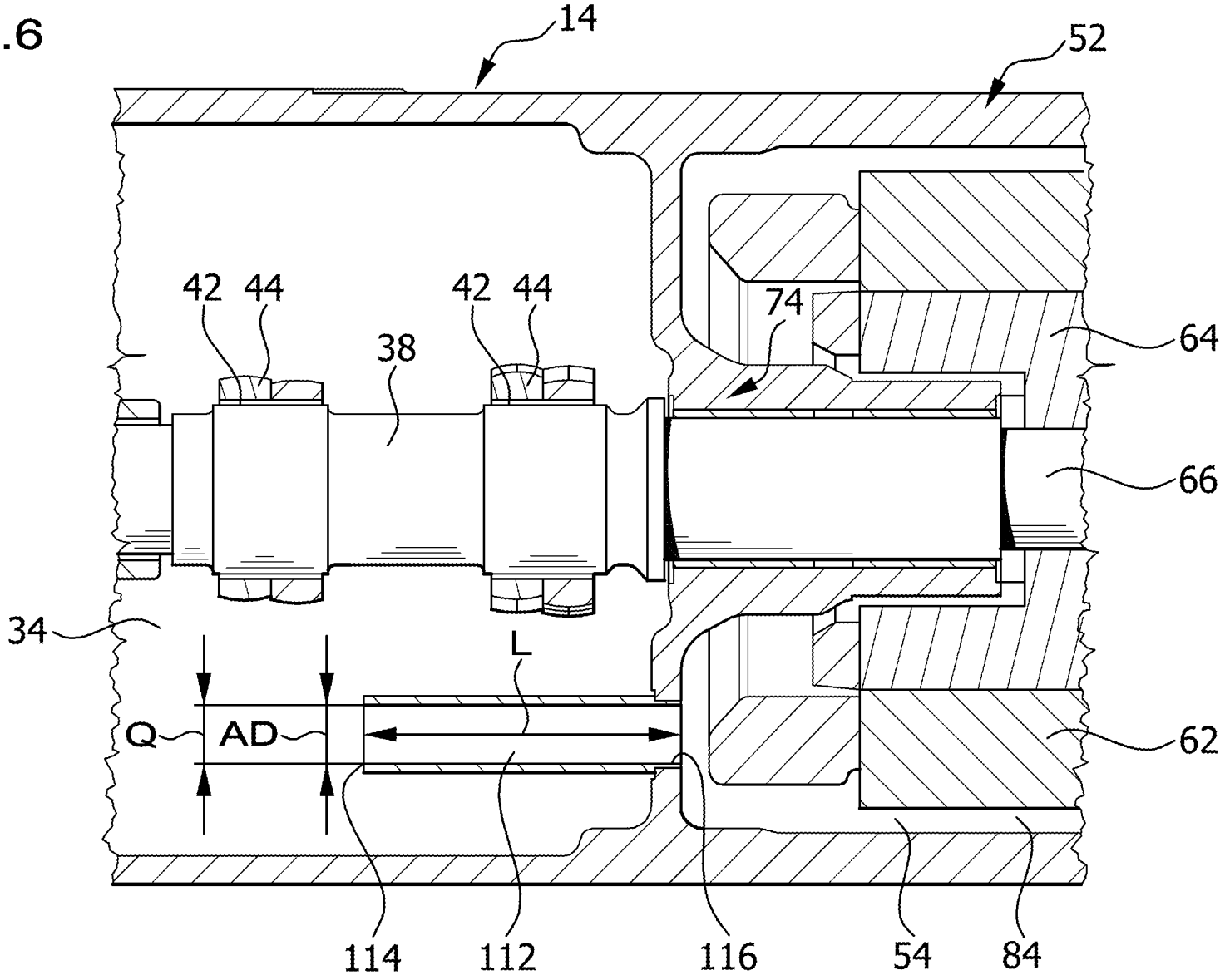
FIG. 6 shows an enlarged detail of part of a region in FIG. 5 that includes a gas equaliser duct.

In order to equalise all types of pressure differences between the drive chamber 34 and the intake duct 84, for example triggered by blow-by flow in the compressor unit 16 or suction gas pulses or other effects, a gas equaliser duct 112 illustrated in FIGS. 2, 3 and 5 is provided, and this passes through the separating wall 72 and enables the above-mentioned equalisation of gas between the drive chamber 34 and the intake duct 84, in particular in this case the motor compartment 54.

In particular, the gas equaliser duct 112 extends such that—as illustrated in FIG. 2—an opening 114 therein on the drive chamber side lies in the drive chamber 34 at a sufficient spacing from a surface 118 of the lubricant bath 48 in the drive chamber 34, and an opening 116 in the gas equaliser duct 112 on the intake duct side likewise lies in the intake duct 84, in particular in the motor compartment 54, at a sufficient height above the accumulation 102 of lubricant.

Preferably, the gas equaliser duct 112 is formed by a pipe that is inserted into the separating wall 72 and held thereby, wherein the pipe preferably extends from the separating wall 72 into the drive chamber 34.

In order to prevent drops of lubricant in the drive chamber 34 from being transported from the drive chamber 34 and into the intake duct 84, in particular the motor compartment 54, through the gas equaliser duct 112 at the time of gas equalisation between the drive chamber 34 and the intake duct 84 and thus also the motor compartment 54, the intake duct 112 takes a form such that it has a duct length L between the opening 114 on the drive chamber side and the opening 116 on the intake duct side of at least 40 mm, or better at least 60 mm, preferably at least 80 mm and by particular preference at least 100 mm or even better at least 110 mm.

Further, it is preferably provided for the gas equaliser duct 112 to have a duct cross sectional surface area Q of at least 80 $mm^2$, or better 120 $mm^2$, even better at least 180 $mm^2$, preferably at least 250 $mm^2$ or most particularly advantageously at least 300 $mm^2$.

In particular, it is provided for the duct length L of the gas equaliser duct 112 to correspond to at least twice, or better at least three times, or even better at least four times, preferably at least five times and by preference at least six times the equivalent duct diameter AD, wherein the equivalent duct diameter AD corresponds to the diameter of a gas equaliser duct 112 that is circular in cross section or, in the case of a gas equaliser duct 112 having a cross sectional shape differing from a circular cross sectional shape, corresponds to the duct diameter of a duct cross sectional surface area Q that is circular in cross section and is of the same size as the duct cross sectional surface area Q' of the gas equaliser duct 112 differing from the circular cross sectional shape.

Dimensions of this kind for the gas equaliser duct 112 make it possible for substantially no lubricant transport, in particular no transport of droplets of lubricant, to take place through the gas equaliser duct 112 from the drive chamber 34 and into the intake duct 84, in particular the motor compartment 54.

This is possible because, as a result of the duct length L and the duct cross sectional surface area Q of the gas equaliser duct 112, there is formed in the gas equaliser duct 112 a column of gas that moves to and fro as a result of the pressure differences 84 between the opening 114 on the drive chamber side and the opening 116 on the intake duct side, wherein movements of the column of gas are limited as a result of the large cross sectional surface area Q and the large duct length L of the gas equaliser duct 112 such that, during the to-and-fro movement of the column of gas, no lubricant droplets are transported from the opening 114 on the drive chamber side, in the drive chamber 34, to the opening 116 on the intake duct side and no lubricant droplets exit therefrom.

Rather, during the to-and-fro movement of the column of gas in the lubricant duct 112, the lubricant droplets entering through the opening 114 on the drive chamber side do not migrate to the opening 116 on the intake duct side but only into the gas equaliser duct 112 and substantially out of it again at the opening 114 on the drive chamber side, or only migrate far enough to remain in the gas equaliser duct 112 and if appropriate settle there.

In particular, the solution according to the invention on the one hand enables the lubricant accumulating in the intake duct 84 and in particular in the motor compartment 54 to be supplied from the accumulation 102 of lubricant, by way of the nonreturn valve 106 to the lubricant bath 48 in the drive chamber 34, and on the other enables the possibility of transporting lubricant droplets through the gas equaliser duct 112 from the drive chamber 34 and into the intake duct 84, in particular the motor compartment 54, to be prevented, and thus overall enables the spurting of lubricant in refrigerant compressors of this kind to be reduced, in particular if these are operated as transcritical $CO_2$ machines.

In particular, the gas equaliser duct 112 having the above dimensions and functioning thus enables the spurting of lubricant at the outtake connector 96 to be significantly reduced.

Figure 7:
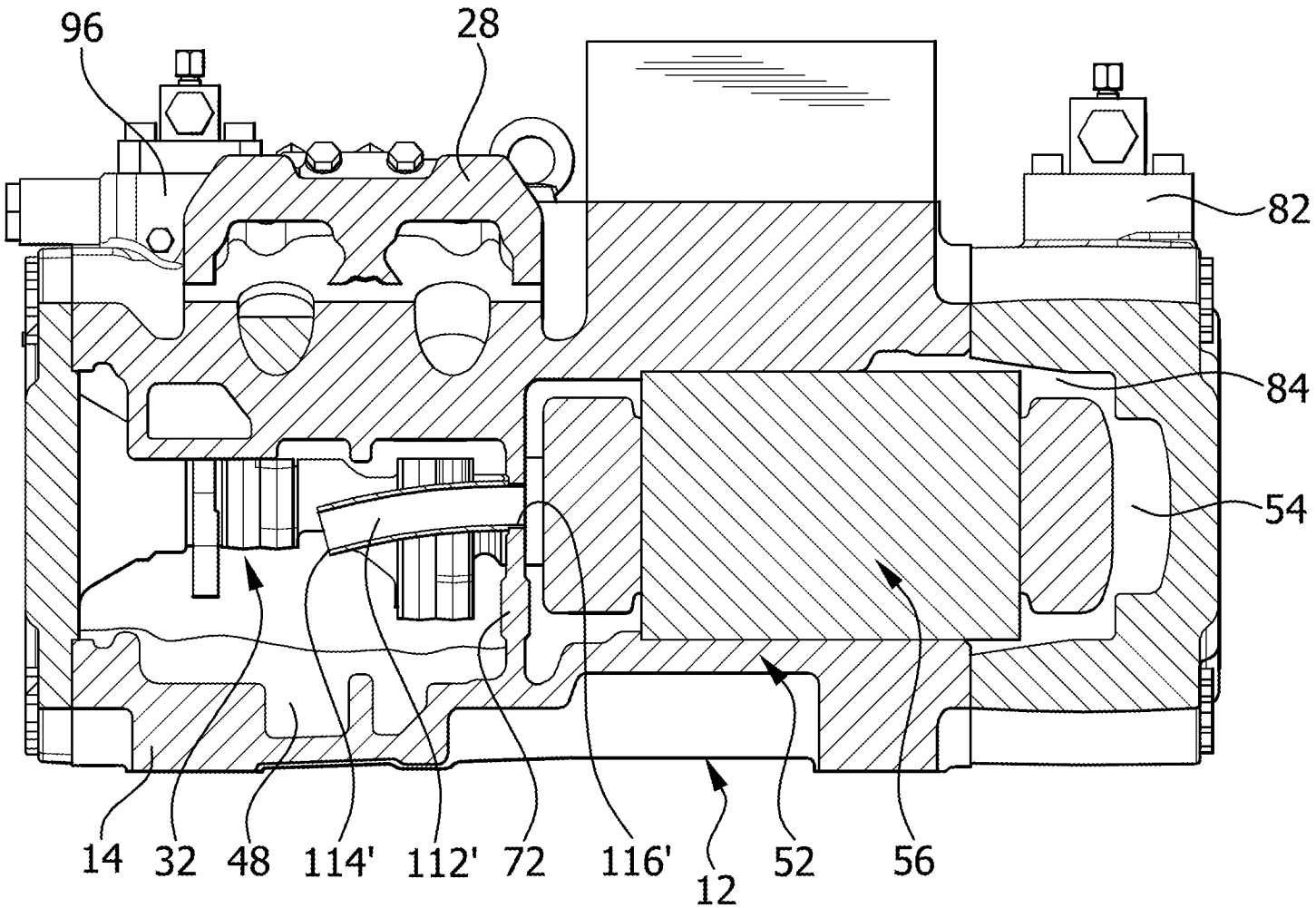
FIG. 7 shows a section similar to FIG. 3, through a second exemplary embodiment of a refrigerant compressor according to the invention.

In a second exemplary embodiment of a refrigerant compressor according to the invention, illustrated in FIG. 7, the gas equaliser duct 112' takes a form that descends in the direction of the drive chamber 34 such that the opening 116' thereof on the intake duct side is higher up, as seen in the direction of gravity, than the opening 114' on the drive chamber side, with the result that, in the event that lubricant is deposited in the gas equaliser duct 112', it exits from the opening 114' on the drive chamber side under the action of gravity and accumulates in the lubricant bath 48.

In this way, it is additionally ensured that no lubricant deposited in the gas equaliser duct 112' undesirably enters the intake duct 84.

Figure 8:
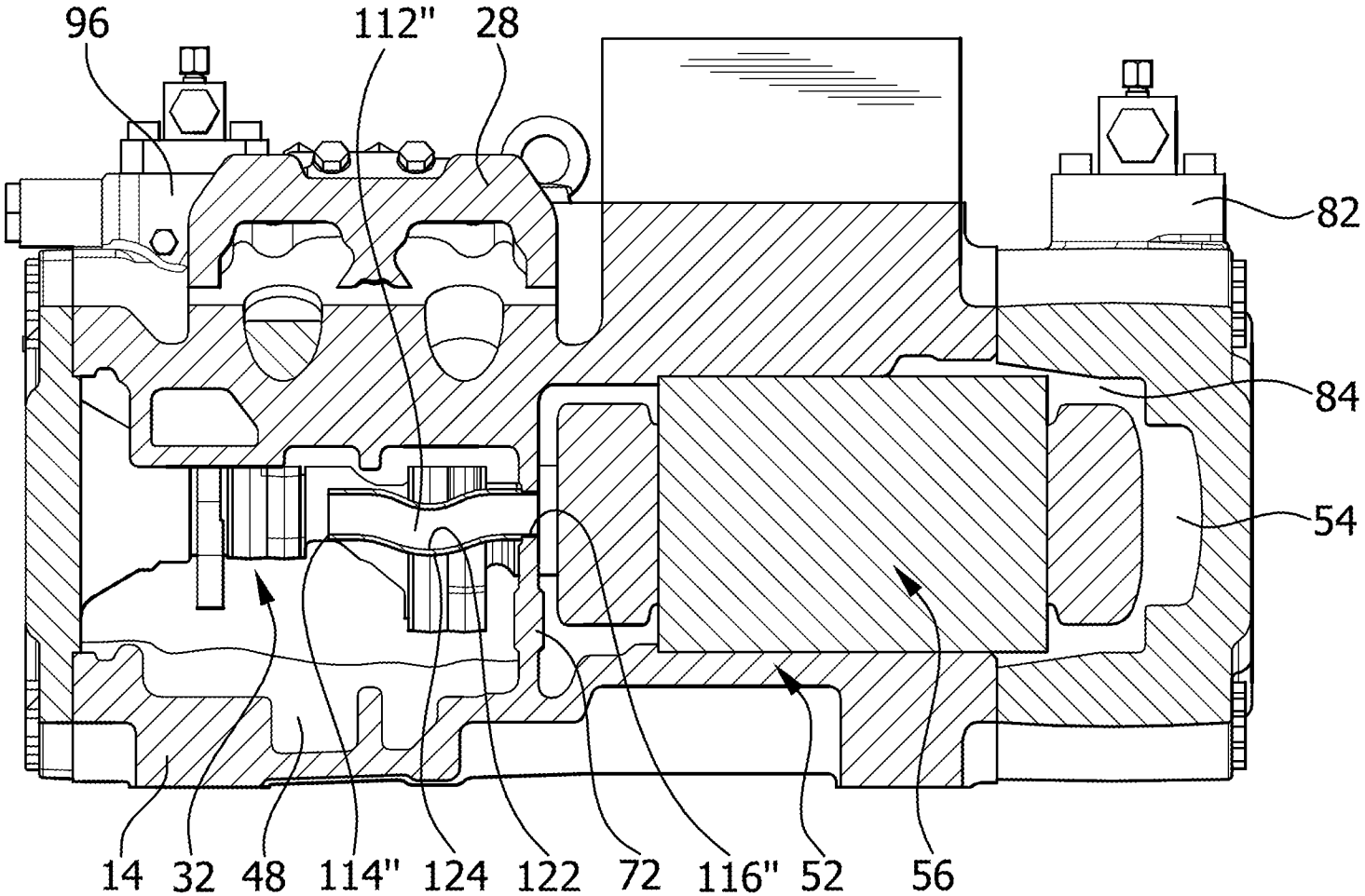
FIG. 8 shows a section similar to FIG. 3, through a third exemplary embodiment of a refrigerant compressor according to the invention.

In a third exemplary embodiment of a refrigerant compressor according to the invention, illustrated in FIG. 8, the gas equaliser duct 112" takes a form such that, between the opening 114" on the drive chamber side and the opening 116" on the intake duct side, it has a lowest point 122 at which lubricant that is settled in the gas equaliser duct 112" accumulates.

Further, associated with the lowest point 122 there is also a drip opening 124 that is smaller by comparison with the duct cross sectional surface area Q, in particular by a factor of 10, and enables the lubricant accumulating at the lowest point 122 to exit from the gas equaliser duct 112" and—where appropriate through an additional line—to be supplied to the lubricant bath 48 under the action of gravity.

A lowest point 122, as seen in the direction of gravity, of this kind can be achieved for example in that the gas equaliser duct 112" has a downwardly pointing deflection, as seen in the direction of gravity, wherein this deflection is preferably located in the drive chamber 34, such that the lubricant exiting from the drip opening is supplied to the lubricant bath 48 without a further line.

The invention claimed is:

1. A refrigerant compressor, in particular for a refrigeration system, including a common housing, an electrical drive motor arranged in a motor compartment in the common housing, a compressor arranged in the common housing, a mechanical compressor drive for the compressor driven by the electrical drive motor, the mechanical compressor drive arranged in a drive chamber of the common housing, a lubricant bath forming in the drive chamber, an intake duct that extends in the common housing in a manner separated from the drive chamber and through which the compressor draws in by suction refrigerant that is to be compressed, the intake duct and the drive chamber are connected by way of a gas equaliser duct, which allows a permanent equalisation of gas between them, and which has on one side an opening on a drive chamber side and on the other an opening on an intake side, and of which the duct length between the openings corresponds to at least twice an equivalent duct diameter, in particular a smallest equivalent duct diameter, of the gas equaliser duct, wherein the opening in the gas equaliser duct on the intake side is higher up, as seen in a direction of gravity, than an accumulation of lubricant in the intake duct, and wherein the intake duct passes through the motor compartment, and in that the accumulation of lubricant forms on a base of the motor compartment, and wherein the gas equaliser duct connects the drive chamber to the motor compartment.

2. The refrigerant compressor according to claim 1, wherein the duct length of the gas equaliser duct corresponds to at least three times an equivalent duct diameter.

3. The refrigerant compressor according to claim 1, wherein the gas equaliser duct has a duct length of at least 40 mm.

4. The refrigerant compressor according to claim 1, wherein the gas equaliser duct has a duct cross sectional surface area of at least 80 $mm^2$.

5. The refrigerant compressor according to claim 1, wherein the opening in the gas equaliser duct on the drive chamber side is higher up, as seen in the direction of gravity, than the lubricant bath in the drive chamber.

6. The refrigerant compressor according to claim 1, wherein the opening in the gas equaliser duct on the drive chamber side is arranged at least at the height of a drive shaft of the compressor drive, as seen in the direction of gravity.

7. The refrigerant compressor according to claim 1, wherein the opening in the gas equaliser duct on the drive chamber side is arranged laterally next to the compressor drive in the drive chamber.

8. The refrigerant compressor according to claim 1, wherein the gas equaliser duct passes through a separating element between the drive chamber and the intake duct.

9. The refrigerant compressor according to claim 1, wherein the gas equaliser duct extends within or along the drive chamber over at least half of its duct length.

10. The refrigerant compressor according to claim 1, wherein, as gas is equalised in the gas equaliser duct, a column of gas lying between the openings moves to and fro in the gas equaliser duct without flowing through the gas equaliser duct.

11. The refrigerant compressor according to claim 1, wherein a column of gas lying between the openings moves to and fro in the gas equaliser duct with suction gas pulses that occur in the intake duct such that the column of gas does not bring about any transport of lubricant droplets from the drive chamber into the intake duct.

12. The refrigerant compressor according to claim 1, wherein a column of gas lying in the gas equaliser duct between the openings moves to and fro in the gas equaliser duct with suction gas pulses in the intake duct only such that lubricant droplets at the opening on the drive chamber side at most enter the gas equaliser duct but do not exit from the opening thereof on the intake side.

13. The refrigerant compressor according to claim 1, wherein a lubricant return line is provided which supplies lubricant from an accumulation of lubricant forming in the intake duct to the drive chamber, and which in particular prevents lubricant from being transported from the drive chamber into the intake duct.

14. The refrigerant compressor according to claim 1, wherein a lubricant return line includes a nonreturn valve.

15. The refrigerant compressor according to claim 1, wherein the refrigerant compressor is a semi-hermetic compressor, in which flow of the intake duct passes through the motor compartment for the purpose of cooling a drive motor.

16. The refrigerant compressor according to claim 1, wherein the compressor takes the form of a piston compressor.

17. The refrigerant compressor according to claim 1, wherein the compressor drive includes a drive shaft having cams and connecting rods driven by the cams.

18. The refrigerant compressor according to claim 1, wherein the duct length of the gas equaliser duct corresponds to at least 5 times an equivalent duct diameter.

19. The refrigerant compressor according to claim 1, wherein the gas equaliser duct has a duct length of at least 80 mm.

20. The refrigerant compressor according to claim 1, wherein the gas equaliser duct has a duct cross sectional surface area of at least 180 $mm^2$.

21. A refrigerant compressor, in particular for a refrigeration system, including a common housing, an electrical drive motor arranged in a motor compartment in the common housing, a compressor arranged in the common housing, a mechanical compressor drive for the compressor driven by the electrical drive motor, the mechanical compressor drive arranged in a drive chamber of the common housing, a lubricant bath forming in the drive chamber, an intake duct that extends in the common housing in a manner separated from the drive chamber and passes through the motor compartment and through the intake duct the compressor draws in by suction refrigerant that is to be compressed, the intake duct and the drive chamber are connected by way of a gas equaliser duct, which allows a permanent equalisation of gas between them, and which has on one side an opening on a drive chamber side and on the other an opening on an intake side, and of which the duct length between the openings corresponds to at least twice an equivalent duct diameter, in particular a smallest equivalent duct diameter, of the gas equaliser duct, wherein the gas equaliser duct passes through a wall extending within the common housing between the drive chamber and the intake duct with the wall carrying a bearing unit for a drive shaft of said mechanical compressor drive.

22. A refrigerant compressor, in particular for a refrigeration system, including a common housing, an electrical drive motor arranged in a motor compartment in the common housing, a compressor arranged in the common housing, a mechanical compressor drive for the compressor driven by the electrical drive motor, the mechanical compressor drive arranged in a drive chamber of the common housing, a lubricant bath forming in the drive chamber, an intake duct that extends in the common housing in a manner separated from the drive chamber and passes through the motor compartment and through the intake duct the compressor draws in by suction refrigerant that is to be compressed, the intake duct and the drive chamber are connected by way of a gas equaliser duct, which allows a permanent equalisation of gas between them, and which has on one side an opening on a drive chamber side and on the other an opening on an intake side, and of which the duct length between the openings corresponds to at least twice an equivalent duct diameter, in particular a smallest equivalent duct diameter, of the gas equaliser duct, and wherein the gas equaliser duct passes through a wall extending within the common housing between a compressor section and a motor section of said common housing.

23. A refrigerant compressor, in particular for a refrigeration system, including a common housing, a compressor arranged in the common housing, a mechanical compressor drive for the compressor driven by the electrical drive motor, the mechanical compressor drive arranged in a drive chamber of the common housing, a lubricant bath forming in the drive chamber, an intake duct that extends in the common housing in a manner separated from the drive chamber and passes through the motor compartment and through said intake duct the compressor draws in by suction refrigerant that is to be compressed, the intake duct and the drive chamber are connected by way of a gas equaliser duct, which allows a permanent equalisation of gas between them, and which has on one side an opening on a drive chamber side and on the other an opening on an intake side, and of which the duct length between the openings corresponds to at least twice an equivalent duct diameter, in particular a smallest equivalent duct diameter, of the gas equaliser duct, and wherein the gas equaliser duct passes through a wall extending within the common housing between the drive chamber and the intake duct and wherein the gas equaliser duct is entirely below a head and valve plate for the compressor.

* * * * *